US006955580B2

(12) United States Patent
Fulton

(10) Patent No.: US 6,955,580 B2
(45) Date of Patent: Oct. 18, 2005

(54) WEIGHTS FOR MODEL AND RACING CARS

(75) Inventor: C. Dwayne Fulton, Osage Beach, MO (US)

(73) Assignee: Osment Models, Inc., Linn Creek, MO (US)

( * ) Notice: Subject to any disclaimer, the term of this patent is extended or adjusted under 35 U.S.C. 154(b) by 0 days.

(21) Appl. No.: 10/681,681

(22) Filed: Oct. 8, 2003

(65) Prior Publication Data

US 2005/0079788 A1 Apr. 14, 2005

(51) Int. Cl.[7] ..... A63H 17/02
(52) U.S. Cl. ..... 446/6; 446/95; 446/465
(58) Field of Search ..... 446/6, 93, 95, 446/275, 465, 470

(56) References Cited

U.S. PATENT DOCUMENTS 3,280,500 A * 10/1966 Fairbairn ..... 446/466
3,462,878 A * 8/1969 Perryman et al. ..... 446/468
3,621,609 A * 11/1971 La Branche ..... 446/469
3,711,989 A * 1/1973 Nielsen et al. ..... 446/469
3,842,532 A * 10/1974 Nielsen ..... 446/470

OTHER PUBLICATIONS http://www.pinecar.com/.*
http://www.archive.org/web/*/http://www.pinecar.com/*
http://www.scoutstuff.org/.*
http://archive.org/.*

* cited by examiner

*Primary Examiner*—Derris H. Banks
*Assistant Examiner*—Ali Abdelwahed
(74) *Attorney, Agent, or Firm*—J. David Wharton; Stinson Morrision Hecker LLP

(57) ABSTRACT

A weight and method of providing mass for a model racing car is the subject of the present application. The weight is comprised of two portions. The first portion simulates the undercarriage of an automobile and the second portion comprises multiple components joined by lines of weakness. The multiple components of the second portion can be broken away to vary the total mass of the weight. The method comprises forming a weight having a first component of the configuration of an automobile undercarriage and a second component comprised of a plurality of sections joined by lines of weakness and the step of attaching the weight to the bottom of a model racing car. Portions of one of the components may be removed to vary the total mass.

10 Claims, 1 Drawing Sheet

WEIGHTS FOR MODEL AND RACING CARS

BACKGROUND OF THE INVENTION

This invention relates to model racing cars and, in particular, to a weight for placement on the bottom of a model car to increase its mass and thus its speed.

Model race cars made from a block of wood are well known and are popular among youth. Organized competition is common and the Boy Scouts of America sponsors official races under the name Pinewood Derby while other competition is conducted under the name Pinecar Derby.

It is known to utilize weights in conjunction with model cars to increase their mass and accordingly, their speed as they move down an incline under the force of gravity. In organized competition, the amount of weight which a particular car may have added to it is subject to the regulations governing the race. The amount of weight may vary depending upon the size and style of the car, other accessories which are added, and the regulations of the sponsor.

DESCRIPTION OF RELATED ART

It is well known to employ a weight mass on the bottom of a model car which includes a number of components that are joined by lines of weakness so that portions may be broken off and the amount of weight added to the car thus varied. These prior art weights have taken the form of rectangles or squares with multiple components which may be broken apart. While the prior art weights are functional, they do not provide any aesthetic enhancement to the car.

BRIEF SUMMARY OF THE INVENTION

All of the competitors in model racing like for their cars to be as realistic as possible, or is some cases as futuristic as possible. In some instances the cars may actually be judged based on the accurate reproduction of actual automobile features. The present invention addresses the need to provide realism in model cars by of either a present day or futuristic design providing for a weight which is coupled with the under side of the model car and which is in the form of a simulated undercarriage for the car. The weight also includes multiple components which are joined together by lines of weakness so that the total mass of the added weight can be varied to meet the requirements of individual cars and varying regulations.

It is therefore an object of the present invention to provide a weight for a model car which is more aesthetically pleasing than the flat rectangular body weights of the prior art.

Another object of the invention is to provide an aesthetically pleasing weight for a model racecar which provides the car with a more realistic appearance than is possible with the weights heretofore utilized.

Another object of the invention is to provide structure for covering the axle slots of a model car so as to make the axles more realistic in appearance relative to the overall undercarriage.

A further objective of this invention is to provide a weight for a model car which meets all of the foregoing objects and also provides for the weight to have removable components to vary the total mass of the car.

DETAILED DESCRIPTION OF THE INVENTION

The present invention encompasses a weight for a model car which includes a first portion that simulates the undercarriage of an automobile and may include multiple components and a second portion comprising multiple components joined by lines of weakness whereby one or more of the components of one of the portions can be broken away to vary the total mass of the weight.

Figure 3:
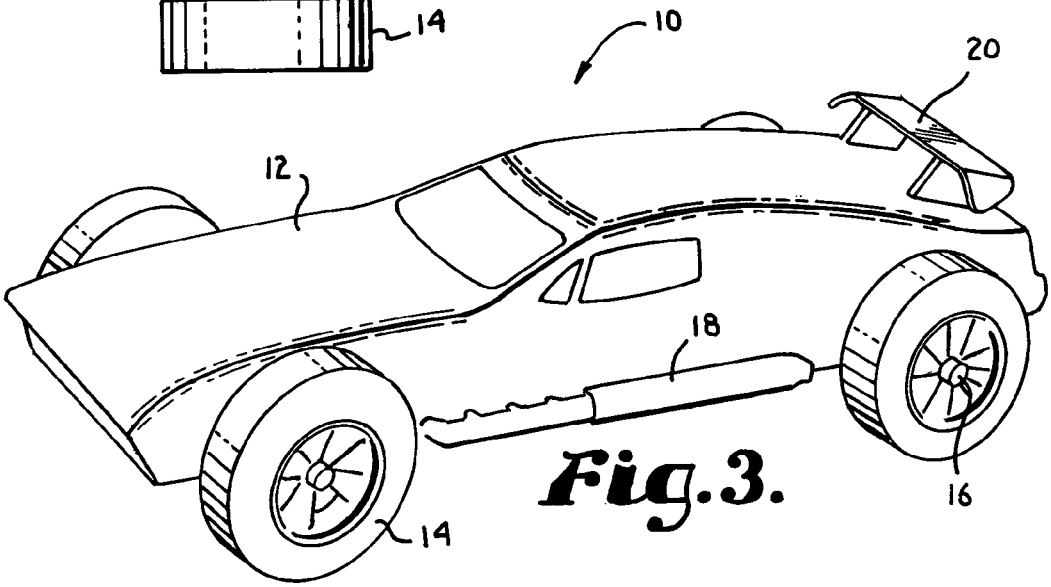
FIG. 3 is a perspective view of a model racing car having the weight mass according to the present invention attached.

Referring to the drawing, a model car with which the weight, according to the present invention is intended to be used is shown in FIG. 3 and designated generally by the numeral 10. Car 10 includes a body 12, wheels 14, and an axle 16. In the embodiment shown, body 12 includes an external exhaust pipe 18 and an air foil 20.

Figure 1:
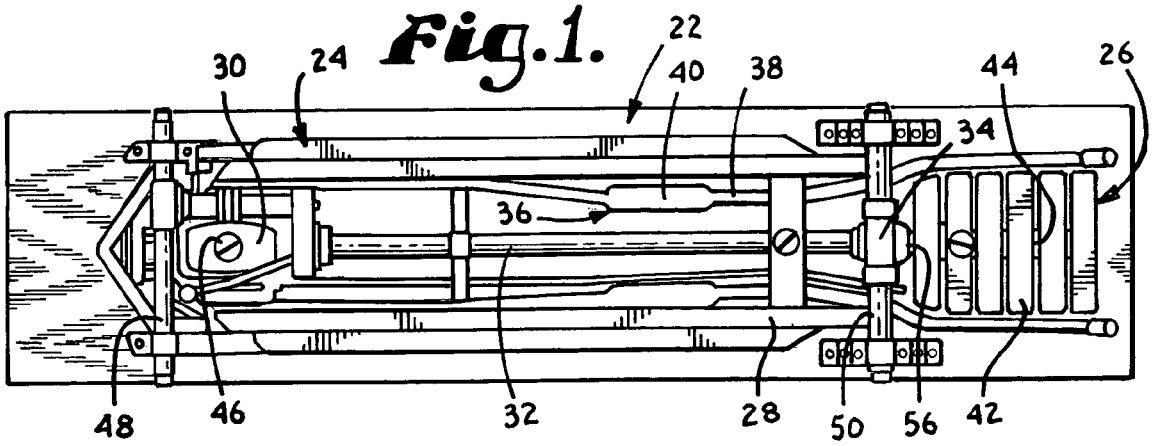
FIG. 1 is a bottom plan view of a model racing car with a weight according to the present invention affixed.

Referring to FIG. 1, the weight according to the present invention is designated generally by the numeral 22 and includes a first component 24 and a second component 26.

First component 24 is designed to simulate the undercarriage of an automobile and includes a frame section 28, an engine section 30, a driveshaft 32 and a rear differential 34. In addition, weight 22 includes a simulated exhaust section 36 which includes exhaust pipes 38 and mufflers 40. Second weight component 26 includes a plurality of generally rectangular segments 42 which are joined together by lines of weakness 44.

Weight 22 is provided with three apertures which receive screws 46 for coupling the weight to the bottom of body 12.

Weight 22 further includes a first axle simulating portion 48 near the front of the body 12 and a second axle simulating portion 50 near the rear of body 12. Each of portions 48 and 50 covers an axle 52 for mounting wheels 14 which is received in a groove in body 12. First weight component 24 is integrally joined with second weight component 26 through linkage 56.

Figure 2:
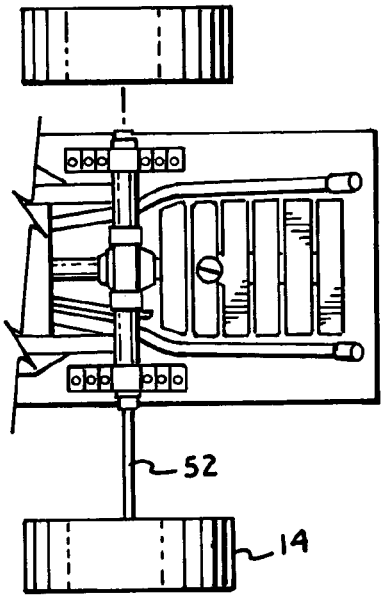
FIG. 2 is a fragmentary bottom plan view similar to FIG. 1, showing details of one portion of the weight and indicating the manner for coupling axles and wheels.

In use, axles 52 are placed in grooves in car body 12 and weight 22 is secured to the bottom of body 12 utilizing screws 46 as a coupler. Once weight 22 is in place, axles 52 are held in place and wheels 14 are secured to the axles. While only one axle is shown FIG. 2, it is to be understood that axles would be placed at both the front and rear end of the body for mounting a total of four wheels. As previously discussed, the total amount of mass required for weight 22 may be different from one car to another and from one race to another. Thus, one or more rectangular elements 42 may be removed by bending the element relative to an adjacent element until the two elements are separated along line of weakness 44. This, of course, varies the total mass of the weight. Removal of individual segments 42 will normally be done before the weight is secured to the body, but it is also possible to remove the individual elements after the weight has been coupled with the body.

While in the preferred embodiment the first component comprises the undercarriage simulating structure and the second component comprises a plurality of rectangular weight segments joined by lines of weakness, it is to be understood that the invention encompasses a weight wherein portions of the simulated undercarriage may be removed to vary the mass. Any application where there is a simulated automobile undercarriage which includes multiple components joined by lines of weakness with one or more of the components removable to vary the total mass is encompassed within the scope of the present invention.

The present invention also encompasses a method of providing mass for a model racing car which includes the step of forming a weight in the shape of an automobile undercarriage with multiple components joined by lines of weakness and then attaching the weight to the bottom of the model racing car. In the preferred embodiment the step of forming the weight will encompass forming the weight with a first component in the shape of a frame and engine and a second component comprising multiple segments joined by lines of weakness. The method includes the step of removing one or more of the components, such as one or more of the segments, to vary the weight of the car.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

What is claimed and desired to be secured by Letters Patent is as follows:

1. A weight for placement on a model racing car having a front, a rear and a bottom, said weight having a total mass and comprising:

a simulated undercarriage resembling a frame section and mechanical components of an automobile including multiple components joined by lines of weakness whereby one or more of said components can be broken away to vary said total mass of the weight.

2. A weight as set forth in claim 1, wherein said undercarriage has a shape and comprises a first component in the shape of a frame and an engine and a second component comprising multiple segments joined by lines of weakness.

3. The invention of claim 2, wherein said first component includes an exhaust system simulating section.

4. The invention of claim 2, wherein said first component includes a coupler which cooperates with a fastener to join said weight to said model racing car.

5. The invention of claim 1, wherein a first component is configured to be placed at said front of said car and a second component is configured to be placed at said rear of said car.

6. A weight for placement on a model racing car having a front end, a rear end and a bottom, said weight having a mass and comprising:

a first component which simulates an undercarriage of an automobile, said first component including a frame simulating section, an engine simulating section and an exhaust simulating section;

said first component being adapted to be placed at one end of said car; and a second component coupled with said first component at the other end of said car and comprising multiple components joined by lines of weakness whereby one or more of said components can be broken away to vary a total mass of said weight.

7. A method of providing mass for a model racing car having a front, a rear and a bottom comprising the steps of:

forming a weight in the shape of an automobile undercarriage resembling a frame section and mechanical components of an automobile with multiple components joined by lines of weakness; and attaching said weight to said bottom of said model racing car.

8. A method as set forth in claim 7, including the step of removing one or more of said components to vary the mass of said car.

9. A method as set forth in claim 7, comprising forming said shape of said weight to present a first component in the shape of a frame and an engine and a second component comprising multiple segments joined by lines of weakness.

10. A method as set forth in claim 9, including the step of removing one or more of said segments to vary the weight of said car.

* * * * *